US009384740B2

(12) United States Patent
Kim et al.

(10) Patent No.: US 9,384,740 B2
(45) **Date of Patent: *Jul. 5, 2016**

(54) APPARATUS AND METHOD FOR ENCODING AND DECODING MULTI-CHANNEL SIGNAL

(71) Applicant: SAMSUNG ELECTRONICS CO., LTD., Suwon-si, Gyeonggi-do (KR)

(72) Inventors: Jung-Hoe Kim, Seongnam-si (KR); Eun Mi Oh, Seongnam-si (KR); MiYoung Kim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

This patent is subject to a terminal disclaimer.

(21) Appl. No.: 14/195,045

(22) Filed: Mar. 3, 2014

(65) Prior Publication Data

US 2014/0177849 A1 Jun. 26, 2014

Related U.S. Application Data

(63) Continuation of application No. 12/659,696, filed on Mar. 17, 2010, now Pat. No. 8,666,752.

(30) Foreign Application Priority Data

Mar. 18, 2009 (KR) ..... 10-2009-0023158

(51) Int. Cl.
*G10L 21/00* (2013.01)
*G10L 19/00* (2013.01)
*G10L 19/008* (2013.01)

(52) U.S. Cl.
CPC ..... *G10L 19/008* (2013.01)

(58) Field of Classification Search
CPC ..... G10L 19/20; G10L 19/008
USPC ..... 704/500–504, 205, 201, 211, 216, 217, 704/218, 219, 220, 230
See application file for complete search history.

(56) References Cited

U.S. PATENT DOCUMENTS 5,463,424 A * 10/1995 Dressler ..... H04S 3/02 348/485
8,254,584 B2 8/2012 Kim et al.

(Continued)

FOREIGN PATENT DOCUMENTS

CN 1981326 A 6/2007
CN 101036183 A 9/2007

(Continued)

OTHER PUBLICATIONS

J. Lapierre and R. Lefebvre, "On improving parametric stereo audio coding," in 120th Convention, Paris, May 2006, Audio Eng. Soc.*

(Continued)

*Primary Examiner* — Edgar Guerra-Erazo
(74) *Attorney, Agent, or Firm* — Sughrue Mion, PLLC

(57) ABSTRACT

Provided are an encoding apparatus and a decoding apparatus of a multi-channel signal. The encoding apparatus of the multi-channel signal may process a phase parameter associated with phase information between a plurality of channels constituting the multi-channel signal, based on a characteristic of the multi-channel signal. The encoding apparatus may generate an encoded bitstream with respect to the multi-channel signal using the processed phase parameter and a mono signal extracted from the multi-channel signal.

4 Claims, 5 Drawing Sheets

(56) References Cited

U.S. PATENT DOCUMENTS

| | | | | |
|---|---|---|---|---|
| 8,654,985 | B2 | 2/2014 | Villemoes et al. | |
| 8,767,850 | B2 | 7/2014 | Kim et al. | |
| 2003/0054847 | A1 | 3/2003 | Kim et al. | |
| 2005/0203731 | A1 | 9/2005 | Oh et al. | |
| 2005/0226426 | A1* | 10/2005 | Oomen | G10L 19/008 381/23 |
| 2005/0228648 | A1* | 10/2005 | Heikkinen | G10L 19/20 704/205 |
| 2006/0133618 | A1* | 6/2006 | Villemoes | G10L 19/008 381/20 |
| 2007/0127729 | A1 | 6/2007 | Breebaart et al. | |
| 2007/0255572 | A1* | 11/2007 | Miyasaka | G10L 19/008 704/500 |
| 2007/0269063 | A1 | 11/2007 | Goodwin et al. | |
| 2007/0271095 | A1* | 11/2007 | Miyasaka | G10L 19/008 704/230 |
| 2008/0025519 | A1 | 1/2008 | Yu et al. | |
| 2008/0031463 | A1 | 2/2008 | Davis | |
| 2008/0071549 | A1 | 3/2008 | Chong et al. | |
| 2008/0091419 | A1* | 4/2008 | Yoshida | G10L 19/008 704/219 |
| 2008/0253576 | A1* | 10/2008 | Choo | G10L 19/008 381/10 |
| 2009/0110201 | A1* | 4/2009 | Kim | G10L 19/008 381/2 |
| 2009/0157411 | A1* | 6/2009 | Kim | G10L 19/008 704/500 |
| 2009/0171676 | A1* | 7/2009 | Oh | G10L 19/008 704/500 |
| 2009/0240503 | A1* | 9/2009 | Miyasaka | G10L 19/008 704/500 |
| 2010/0046760 | A1 | 2/2010 | Delattre | |
| 2010/0076772 | A1* | 3/2010 | Kim | G10L 19/008 704/500 |
| 2011/0103592 | A1* | 5/2011 | Kim | G10L 19/008 381/22 |
| 2011/0200197 | A1 | 8/2011 | Kim et al. | |
| 2011/0202356 | A1 | 8/2011 | Kim et al. | |
| 2011/0202357 | A1 | 8/2011 | Kim et al. | |
| 2011/0211703 | A1 | 9/2011 | Villemoes et al. | |
| 2011/0255714 | A1* | 10/2011 | Neusinger | G10L 19/008 381/119 |
| 2011/0257968 | A1* | 10/2011 | Kim | G10L 19/008 704/230 |
| 2012/0134501 | A1 | 5/2012 | Choo et al. | |
| 2014/0100856 | A1 | 4/2014 | Beack et al. | |

FOREIGN PATENT DOCUMENTS

| | | | |
|---|---|---|---|
| CN | 102428513 | B | 11/2013 |
| EP | 1768107 | A1 | 3/2007 |
| EP | 1169666 | B1 | 7/2009 |
| EP | 2169666 | A1 | 3/2010 |
| FR | 2911020 | A1 | 7/2008 |
| KR | 10-2008-0089308 | A | 10/2008 |
| KR | 10-2008-0093342 | A | 10/2008 |
| TW | 200746873 | A | 12/2007 |
| WO | 2006048226 | A1 | 5/2006 |

OTHER PUBLICATIONS

Office Action issued Jul. 8, 2015, issued by the European Patent Office in counterpart European Patent Application No. 10753719.3.

Office Action issued Aug. 3, 2015, issued by the State Intellectual Property Office of the People's Republic of China in counterpart Chinese Patent Application No. 201310465155.8.

Office Action issued Oct. 30, 2012, issued by the State Intellectual Property Office of the People's Republic of China in counterpart Chinese Patent Application No. 201080022031.7.

Office Action issued Oct. 30, 2013, issued by the European Patent Office in counterpart European Patent Application No. 10753719.3.

Breebaart, J., et al., "Parametric Coding of Stereo Audio", EURASIP Journal on Applied Signal Processing, 2005; vol. 9, pp. 1305-1322.

Search Report issued Oct. 29, 2010, issued by the International Searching Authority in counterpart International Patent Application No. PCT/KR2010/001698 (PCT/ISA/210).

Written Opinion issued Oct. 29, 2010, issued by the International Searching Authority in counterpart International Patent Application No. PCT/KR2010/001698 (PCT/ISA/237).

Faller, et al., "Binaural Cue Coding Applied to Stereo and Multi-Channel Audio Compression". AES 112th Convention, pp. 1-9; Munich Germany, May 2002.

Oomen, et al., "MPEG4-Ext2: CE on Low Complexity Parametric Stereo", International Organisation for Standardisation, Dec. 2003, pp. 1-37, Hawaii.

Faller, et al., "Binaural Cue Coding—Part II: Schemes and Applications". IEEE Transactions on Speech and Audio Processing, vol. 11 No. 6, pp. 520-531, Nov. 2003.

Lapierre, et al., "On Improving Parametric Stereo Audio Coding," AES 120th Convention, pp. 1-9, Paris, France, May 2006.

Communication issued Sep. 22, 2011, issued by the United States Patent and Trademark Office in counterpart U.S. Appl. No. 12/107,117.

Communication issued Apr. 25, 2012, issued by the United States Patent and Trademark Office in counterpart U.S. Appl. No. 12/107,117.

Communication issued Feb. 6, 2012, issued by the United States Patent and Trademark Office in counterpart U.S. Appl. No. 12/107,117.

Communication dated May 16, 2016, issued by the Korean Intellectual Property Office in corresponding Korean Application No. 10-2010-0024481.

* cited by examiner

APPARATUS AND METHOD FOR ENCODING AND DECODING MULTI-CHANNEL SIGNAL

CROSS-REFERENCE TO RELATED APPLICATIONS

This is a continuation application based on U.S. patent application Ser. No. 12/659,696, filed Mar. 17, 2010, and claims the priority benefit of Korean Patent Application No. 10-2009-0023158, filed on Mar. 18, 2009, in the Korean Intellectual Property Office, the disclosures of which are incorporated herein by reference.

BACKGROUND

1. Field

One or more embodiments relate to an apparatus and method to encode and decode a multi-channel signal, and more particularly, to an apparatus and method to encode and decode a multi-channel signal using phase information.

2. Description of the Related Art

A parametric stereo technology may be used to encode stereo signals. The parametric stereo technology may down-mix an input stereo signal to generate a mono signal, and may extract a stereo parameter that indicates side information associated with the stereo signal. The parameter stereo technology may encode the generated mono signal and the extracted stereo parameter to encode the stereo signal.

Examples of the stereo parameter may include an inter-channel intensity difference parameter (IID) or a channel level difference parameter (CLD), an inter-channel coherence parameter or an inter-channel correlation parameter (ICC), an inter-channel phase difference parameter (IPD), an overall phase difference parameter (OPD), and the like. The IID or the CLD indicates an intensity difference according to an energy level of at least two channel signals included in the stereo signal. The ICC indicates a coherence or a correlation between the at least two channel signals, included in the stereo signal, according to a similarity of wave forms of the two channel signals. The IPD indicates a phase difference between the at least two channel signals included in the stereo signal. The OPD indicates how a phase difference between the at least two channel signals included in the stereo signal is distributed between two channels, based on the mono signal, and the like.

SUMMARY

According to an aspect of one or more embodiments, there may be provide an encoding apparatus including a parameter extractor to extract a plurality of parameters that indicate a characteristic relationship between a plurality of channels constituting a multi-channel signal, a parameter modifier to modify a phase parameter associated with phase information between the plurality of channels, among the plurality of parameters, a parameter encoder to encode the plurality of parameters that includes the modified phase parameter, a mono signal encoder to encode a mono signal that is a down-mixed signal of the multi-channel signal, and a bitstream generator to generate an encoded bitstream with respect to the multi-channel signal using the encoded parameters and the encoded mono signal using at least one processor.

The plurality of parameters may include a channel level difference parameter (CLD) that indicates a level difference between the plurality of channels. When the CLD is zero and an inter-channel phase difference parameter (IPD) is 180 degrees, the parameter modifier may modify the IPD to zero degrees.

According to another aspect of one or more embodiments, there may be provided an encoding apparatus including a parameter extractor to extract a plurality of parameters that indicate a characteristic relationship between a plurality of channels constituting a multi-channel signal, and a parameter encoder to determine whether to encode a phase parameter associated with phase information between the plurality of channels, among the plurality of parameters, and to encode the plurality of parameters that includes the phase parameter, upon determining the phase parameter is to be encoded using at least one processor.

According to still another aspect of one or more embodiments, there may be provided an encoding apparatus including: a parameter extractor to extract a plurality of parameters that indicate a characteristic relationship between a plurality of channels constituting a multi-channel signal, a parameter encoder to quantize the plurality of parameters and to encode the quantized parameters, a mono signal encoder to encode a mono signal that is a down-mixed signal of the multi-channel signal, and a bitstream generator to generate an encoded bitstream with respect to the multi-channel signal using the encoded parameters and the encoded mono signal using at least one processor. The parameter encoder may determine a quantization level of the phase parameter based on a continuity of phase information between a plurality of frames included in the multi-channel signal.

According to yet another aspect of one or more embodiments, there may be provided a decoding apparatus including: a mono signal decoder to restore, from an encoded bitstream of a multi-channel signal, a mono signal that is a down-mixed signal of the multi-channel signal, a parameter decoder to restore, from the bitstream, a plurality of parameters that indicate a characteristic relationship between a plurality of channels constituting the multi-channel-signal, a parameter estimator to estimate an overall phase difference parameter (OPD) between the restored mono signal and the multi-channel signal using the restored parameters using at least one processor, a parameter modifier to modify the estimated OPD, and an up-mixer to up-mix the mono signal using the restored parameters and the modified OPD.

The plurality of parameters may include a CLD and an IPD. The parameter modifier may modify the OPD based on the CLD and the IPD.

According to yet another aspect of one or more embodiments, there may be provided a decoding apparatus including: a mono signal decoder to restore, from an encoded bitstream of a multi-channel signal, a mono signal that is a down-mixed signal of the multi-channel signal, a parameter decoder to restore, from the bitstream, a quantized first phase parameter with respect to phase information between a plurality of channels constituting the multi-channel signal, and quantization type information of the quantized first phase parameter, and to perform inverse quantization for the quantized first phase parameter based on the quantization type information to calculate a second phase parameter using at least one processor, and an up-mixer to up-mix the mono signal using the second phase parameter.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Figure 1:
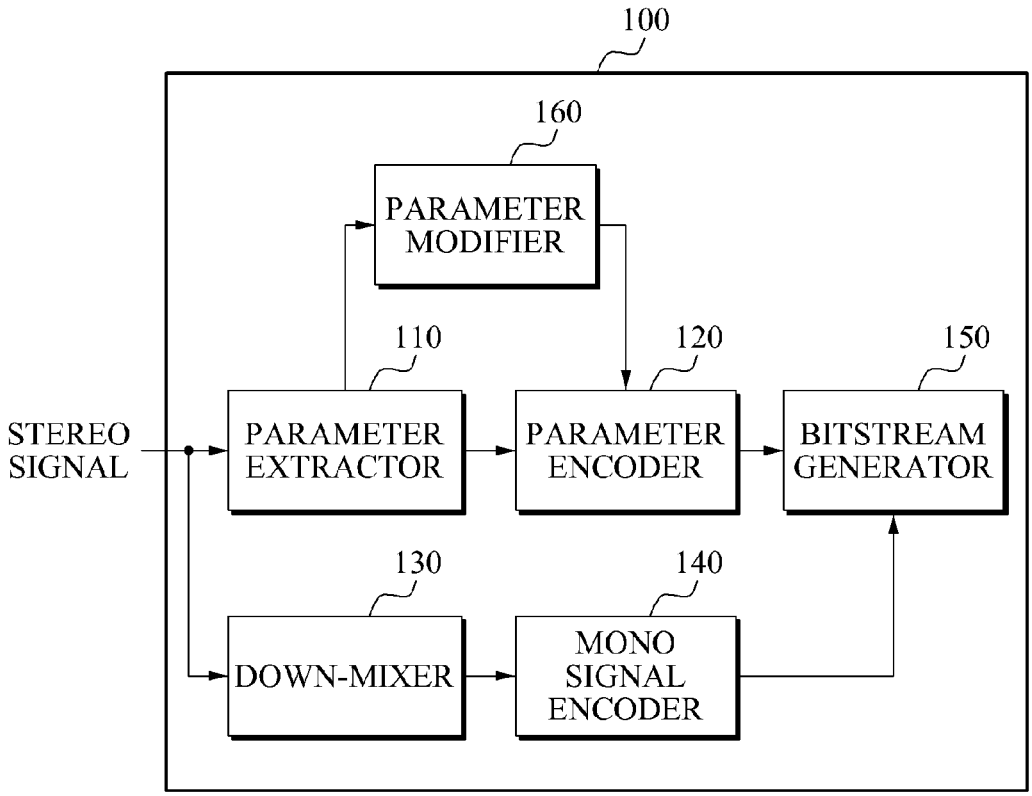
FIG. 1 illustrates a configuration of an encoding apparatus of a multi-channel signal according to an exemplary embodiment.

Reference will now be made in detail to exemplary embodiments, examples of which are illustrated in the accompanying drawings, wherein like reference numerals refer to the like elements throughout. Exemplary embodiments are described below to explain the present disclosure by referring to the figures.

FIG. 1 illustrates a configuration of an encoding apparatus 100 of a multi-channel signal according to an exemplary embodiment.

Referring to FIG. 1, the encoding apparatus 100 may include a parameter extractor 110, a parameter encoder 120, a down-mixer 130, a mono signal encoder 140, and a bitstream generator 150. The encoding apparatus 100 may further include a parameter modifier 160. Hereinafter, a function of each of constituent elements will be described in detail.

The multi-channel signal denotes a signal of multiple channels. Herein, each of the multiple channels included in the multi-channel signal is referred to as a channel signal.

Hereinafter, it is assumed that the multi-channel signal input into the encoding apparatus 100 is a stereo signal including a left-channel signal and a right-channel signal. The multi-channel signal is not limited to the stereo signal and the encoding apparatus 100 may be used to encode the multi-channel signal including the stereo signal.

The parameter extractor 110 may extract a plurality of parameters that indicate a characteristic relationship between the left-channel signal and the right-channel signal constituting the stereo signal. For example, the plurality of parameters may include a channel level difference parameter (CLD), an inter-channel coherence parameter or an inter-channel correlation parameter (ICC), an inter-channel phase difference parameter (IPD), an overall phase difference parameter (OPD), and the like. The IPD and the OPD are examples of a phase parameter concerning phase information between the left-channel signal and the right-channel signal.

The parameter encoder 120 may encode the extracted parameters.

The OPD may be estimated from other parameters. Therefore, the parameter encoder 120 may encode only the CLD, the ICC, and IPD, excluding the OPD from the extracted parameters. Specifically, the parameter encoder may not encode the OPD and thus may not transmit the encoded OPD to thereby decrease a bit amount of a bitstream to be transmitted. An estimation of the OPD will be further described with reference to FIG. 3.

In order to decrease a bit amount allocated for encoding of parameters, the parameter encoder 120 may quantize the extracted parameters and encode the quantized parameters. When the parameter encoder 120 encodes only the CLD, the ICC, and the IPD among the plurality of parameters, the parameter encoder 120 may quantize only the CLD, the ICC, and the IPD, and encode the quantized CLD, ICC, and IPD.

The down-mixer 130 may down-mix the stereo signal to output a mono signal.

Here, down-mixing denotes an operation to generate a mono signal of a single channel from a stereo signal of at least two channels and thus may decrease a bit amount of a bitstream generated in an encoding process. The mono signal may be a signal representing the stereo signal. The encoding apparatus 100 may encode only the mono signal and transmit the encoded mono signal without encoding each of the left-channel signal and the right-channel signal included in the stereo signal.

For example, a magnitude of the mono signal may be obtained by averaging a magnitude of the left-channel signal and a magnitude of the right-channel signal. A phase of the mono signal may be obtained by averaging a phase of the left-channel signal and a phase of the right-channel signal.

The mono signal encoder 140 may encode the output mono signal.

For example, when the stereo signal is a voice signal, the mono signal encoder 140 may encode the mono signal using a code excited linear prediction (CELP) scheme.

As another example, when the stereo signal is a music signal, the mono signal encoder 140 may encode the mono signal using a similar scheme to MPEG-2/4 advanced audio coding (AAC) or MP3.

The bitstream generator 150 may generate an encoded bitstream with respect to the stereo signal using the encoded parameters and mono signal.

As described above, in order to decrease an amount of bits to be transmitted, the encoding apparatus 100 may extract the mono signal and the plurality of parameters from the stereo signal, and may encode the extracted mono signal and parameters and transmit the encoded mono signal and parameters. Also, in order to further decrease an amount of bits used to transmit the plurality of parameters, the encoding apparatus 100 may encode and transmit only the CLD, the ICC, and the IPD excluding the OPD from the plurality of parameters.

However, in the above case, since it is not encoding and transmitting the stereo signal itself, a sound quality may be deteriorated in playing the stereo signal. Accordingly, there is a need for a scheme that may decrease an amount of transmission bits while decreasing the deterioration of the sound quality. Hereinafter, operations of the encoding apparatus 100 to decreasing the deterioration of the sound quality will be described.

The following description is directed to a modification of a phase parameter that indicates phase information between a left-channel signal and a right-channel signal.

When the encoding apparatus 100 encodes only a CLD, an ICC, and an IPD among a plurality of parameters, and transmits the encoded CLD, ICC, and IPD to a decoding end, the decoding end may estimate an OPD using the CLD and the IPD. Here, when the estimated OPD radically changes in a consecutive frame, undesired noise may occur. Hereinafter, noise according to a change in a phase parameter will be described in detail with reference to FIGS. 2A and 2B.

Figure 2A:
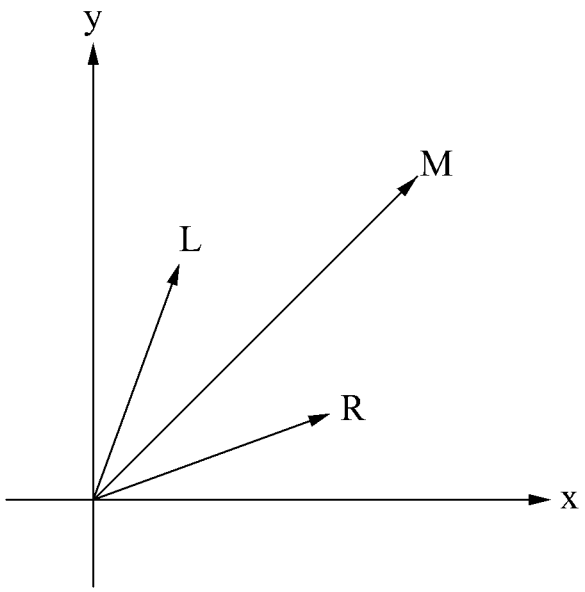
FIGS. 2A and 2B illustrate graphs for describing a change of a phase parameter in consecutive frames included in a stereo signal according to an exemplary embodiment.
Figure 2B:
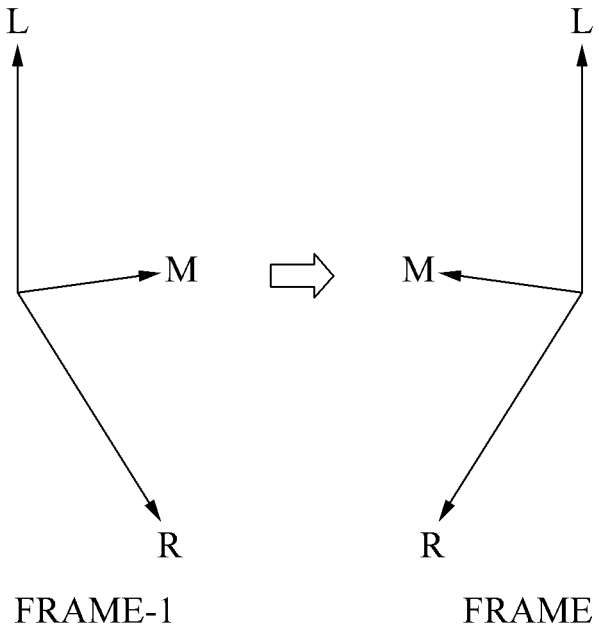

FIGS. 2A and 2B illustrate graphs for describing a change of a phase parameter in consecutive frames included in a stereo signal according to an exemplary embodiment.

FIG. 2A illustrates a relationship among the phase parameter including an IPD and an OPD, a left-channel signal, a right-channel signal, and a mono signal. In the graph of FIG. 2A, "L" denotes the left-channel signal in a frequency domain, "R" denotes the right-channel signal in the frequency domain, and "M" denotes a down-mixed mono signal. The IPD may be calculated according to the following Equation 1:

$$IPD=\angle(L\cdot R), \quad \text{[Equation 1]}$$

where L·R denotes a dot product of the left-channel signal and the right-channel signal, and the IPD denotes an angle between the left-channel signal and the right channel signal.

The OPD may be calculated according to the following Equation 2:

$$OPD=\angle(L\cdot M), \quad \text{[Equation 2]}$$

where L·M denotes a dot product of the left-channel signal and the mono signal, and the OPD denotes an angle between the left-channel signal and the mono signal.

FIG. 2B illustrates an example of a radical change of the phase parameter including the IPD and the OPD in the consecutive frames.

In the graph of FIG. 2B, "FRAME" denotes a current frame and "FRAME-1" denotes a previous frame being one frame prior to the current frame (hereinafter, "previous frame").

As shown in FIG. 2B, when the IPD changes around 180 degrees in the previous frame and the current frame, the IPD may radically change from 180 degrees to −180 degrees based on the left-channel signal, whereby the OPD may also radically change from 90 degrees to −90 degrees based on the left-channel signal. Due to the radical change of the IPD and the OPD, undesired noise may occur in playing a stereo signal. Accordingly, to decrease the noise and enhance a sound quality of the stereo signal, the phase parameter regarding phase information between the left-channel signal and the right-channel signal may need to be modified.

For this, the encoding apparatus 100 may modify the phase parameter extracted by the parameter extractor 110 of FIG. 1, and adjust a change level of the phase parameter in the consecutive frames to decrease the noise occurring in playing the stereo signal. Modification of the phase parameter may be performed by the parameter modifier 160 included in the encoding apparatus 110.

For example, when the CLD is zero and the IPD is 180 degrees, the parameter modifier 160 may modify the IPD to zero degrees. Specifically, when there is no level difference between the left-channel signal and the right-channel signal and an angle between the left-channel signal and the right-channel signal is 180 degrees, the parameter modifier 160 may compulsorily set the IPD to zero degrees.

For example, as shown in FIG. 2B, when the IPD consecutively changes around 180 degrees, the encoding apparatus 100 may modify the IPD to zero degrees at a point in time when the IPD becomes 180 degrees, and may encode the modified IPD and transmit the encoded IPD to a decoding end. The OPD estimated by the decoding end does not radically change from 90 degrees to −90 degrees and may gradually change in an order of 90 degrees, zero degree, and −90 degrees. Accordingly, it is possible to prevent phase information from radically changing during a decoding operation of the stereo signal.

The following description is directed to a selective encoding of a phase parameter.

To decrease an amount of bits allocated for encoding of parameters, the encoding apparatus 100 may quantize extracted parameters, for example, a phase parameter, and may encode and transmit the quantized parameters to a decoding end.

In a case where phase information consecutively changes in consecutive frames included in a stereo signal, for example, in a case where a change level of the phase parameter is small, when the decoding end restores the stereo signal using the phase parameter to play the stereo signal, a sound quality may be deteriorated due to a quantization of the phase parameter and a discontinuous phase value.

Accordingly, the encoding apparatus 100 may determine whether to encode the phase parameter based on a change level, for example, a continuity of phase information between a plurality of frames included in the stereo signal. For example, upon determining the phase information between the plurality of frames is continuous, the encoding apparatus 100 may not encode the phase information. Conversely, upon determining the phase information is discontinuous, the encoding apparatus 100 may encode the phase information. The decision regarding whether to encode the phase parameter may be made by the parameter encoder 120.

In this case, the parameter encoder 120 may determine whether the phase information is continuous, using a phase information value of a current frame, a phase information value of a previous frame being one frame prior to the current frame, and a phase information value of a previous frame being two frames prior to the current frame. Specifically, the parameter encoder 120 may determine a continuity of the phase information in an n-th frame using a phase information value of the n-th frame, a phase information value of an (n−1)-th frame, and a phase information value of an (n−2)-th frame.

For example, the parameter encoder 120 may calculate a first phase difference value that is a difference between a two-fold value of the phase information value of the previous frame being one frame prior to the current frame and the phase information value of the previous frame being two frames prior to the current frame, and may calculate a second phase difference value that is a difference between the phase information value of the current frame and the first phase difference value. When the second phase difference value is greater than a predetermined value, the parameter encoder 120 may determine the phase information is discontinuous, that is, the phase information does not slowly change and thus determine to encode the phase parameter. It may be given by the following Equation 3:

$$PhaseError[band]=Phase[band]-(2\cdot PhasePrev[band]-PhasePrev2[band]), \quad \text{[Equation 3]}$$

where Phase[band] denotes the phase information value of the current frame, PhasePrev[band] denotes the phase information value of the previous frame being one frame prior to the current frame, PhasePrev2[band] denotes the phase information value of the previous frame being two frames prior to the current frame, PhaseError[band] denotes the second phase difference value, and band denotes a frequency band where the phase information is applied.

Accordingly, when PhaseError[band] is greater than the predetermined value, the parameter encoder 120 may determine to encode the phase information. Conversely, when PhaseError[band] is less than or equal to the value, the parameter encoder 120 may determine to not encode the phase information.

Also, the parameter encoder 120 may determine whether the phase information is continuous, using a difference between the phase information value of the current frame and the phase information value of the previous frame being one frame prior to the current frame, and may determine whether to encode the phase parameter based on the decision.

For example, the parameter encoder 120 may calculate the difference between the phase information value of the current frame and the phase information value of the previous frame being one frame prior to the current frame according to the following Equation 4, and calculate a slope of the difference to determine whether the phase information is continuous. Equation 4 may be give by, $$\text{Slope[band]}=\text{Phase[band]}-\text{PhasePrev[band]}, \quad \text{[Equation 4]}$$

where Slope[band] denotes the difference between the phase information value of the current frame and the phase information value of the previous frame being one frame prior to the current frame, and band denotes the frequency band where the phase information is applied.

When Slope[band] changes with greater than or equal to a predetermined slope, noise may occur due to the discontinuity of phase information caused by a quantization. Accordingly, when the slope of Slope[band] is greater than a predetermined value, the parameter encoder 120 may determine to not encode the phase information. Conversely, when the slope of Slope[band] is less than or equal to the predetermined value, the parameter encoder 120 may determine to encode the phase information.

In the above Equation 3 and Equation 4, the parameter encoder 120 may calculate the first phase difference value, the second phase difference value, and the phase difference value between the current frame and the previous frame being one frame prior to the current frame by considering that the phase information consecutively changes based on 360 degrees due to a wrapping property. For example, when the phase difference value is 370 degrees, the parameter encoder 120 may calculate the phase difference value as −10 degrees based on a period of 360 degrees.

As another example, the parameter encoder 120 may combine PhaseError[band] and Slope[band] to determine whether to encode the phase information.

In addition to the continuity of the phase information, the parameter encoder 120 may determine whether to encode the phase parameter, more accurately, the IPD included in the phase parameter based on an ICC extracted by the parameter extractor 110.

The parameter extractor 110 may extract the ICC using the IPD or may extract the ICC without using the IPD. When a difference between the ICC extracted using the IPD and the ICC extracted without using the IPD is greater than a predetermined value, it may be understood that the IPD has more significance than the ICC in a decoding operation of the stereo signal. Conversely, when the difference is less than or equal to the predetermined value, it may be understood that the ICC has more significance than the IPD.

Accordingly, when the difference between the ICC extracted using the IPD and the ICC extracted without using the IPD is greater than the predetermined value, the parameter encoder 120 may determine to encode the IPD.

In this case, the encoding apparatus 100 may encode the IPD and the ICC extracted using the IPD, and transmit the encoded IPD and ICC to the decoding end. The decoding end may restore the stereo signal using the IPD and the ICC, and restore the stereo signal to be close to an original sound.

When the decoding end restores the stereo signal, the decoding end may adjust a mixing level between a decorrelated signal and a mono signal restored using the ICC. Here, the decorrelated signal may correspond to a vertical vector component of the restored mono signal. Accordingly, when the decoding end restores the stereo signal using the ICC extracted using the IPD, it is possible to prevent the decorrelated signal and the restored mono signal from being excessively mixed due to a phase information difference. Through this, the stereo signal may be restored to be close to the original sound.

For example, the parameter extractor 120 may calculate the ICC, extracted using the IPD, according to the following Equation 5:

$$ICC_{band} = \frac{Re\{L \cdot R^* \cdot e^{-iIPD_{band}}\}}{|L| \cdot |R|}. \quad \text{[Equation 5]}$$

A correlation between the left-channel signal and the right-channel signal may be calculated by compensating for phase information. The ICC may be calculated by taking only a real number value of the calculated correlation.

As another example, the parameter extractor may calculate the ICC, extracted using the IPD, according to the following Equation 6:

$$ICC_{band} = \frac{Re\{L \cdot R^* \cdot e^{-iQ^{-1}(Q(IPD_{band}))}\}}{|L| \cdot |R|}, \quad \text{[Equation 6]}$$

where Q denotes a quantization and $Q^{-1}$ denotes an inverse quantization.

When the decoding end restores the stereo signal using the ICC obtained from the above Equation 6, it is possible to compensate for an error that may occur due to the quantization of the phase parameter, which has been described above.

As still another example, the parameter extractor 120 may calculate the ICC, extracted using the IPD, according to the following Equation 7:

$$ICC_{band} = \frac{|L \cdot R^* \cdot e^{-iIPD_{band}}|}{|L| \cdot |R|}. \quad \text{[Equation 7]}$$

The following description is directed to a selective change of a quantization scheme of a phase parameter.

The encoding apparatus 100 may encode a quantized phase parameter and transmit the encoded phase parameter to a decoding end. Accordingly, when the phase parameter is not selectively but uniformly encoded and is transmitted to the decoding end, the encoding apparatus 100 may selectively change the quantization scheme to prevent a sound quality from being deteriorated due to the quantized phase parameter.

When the phase parameter is quantized at wider intervals regardless of a small change in the phase information, that is, regardless of a continuous change in the phase information, the sound quality of the stereo signal played in the decoding end may be deteriorated due to a discontinuous phase value. Accordingly, the encoding apparatus 100 may determine a quantization type of the phase parameter based on the continuity of the phase information. The quantization type may be determined by the parameter encoder 120.

Upon determining the phase information is discontinuous, the parameter encoder 120 may quantize the phase parameter according to a first quantization type. Conversely, upon determining the phase information is continuous, the parameter encoder 120 may quantize the phase parameter according to a second quantization type.

In this case, a number of quantization levels according to the first quantization type may be different from a number of quantization levels according to the second quantization type.

A representative value in the quantization levels, that is, a value quantized in the quantization levels according to the first quantization type may be different from a representative value in the quantization levels according to the second quantization type.

In the above case, a quantization error according to the first quantization type may be different from a quantization error according to the second quantization type. Here, the quantization error denotes a difference value between the quantized value and an unquantized value.

For example, when the phase information is continuous, the parameter encoder 120 may quantize the phase parameter at relatively small intervals, to decrease a deterioration in the sound quality of the stereo signal occurring in the decoding end. In this case, the number of quantization levels according to the first quantization type may be less than the number of quantization levels according to the second quantization type.

In the above case, whether the phase information is continuous may be determined using the above Equation 3 and Equation 4.

When the parameter encoder 120 encodes the phase parameter by selectively applying the quantization type, the bitstream generator 150 may generate a bitstream by further using determined quantization type information. The decoding end receiving the bitstream may perform an inverse-quantization with reference to the quantization type information. When the encoding apparatus 100 does not transmit phase information to the decoding end, the bitstream generator 150 may not include the quantization type information in the bitstream. The decoding end receiving the bitstream not containing the quantization type information may perform the inverse-quantization without reference to the quantization type information. Further detailed description related thereto will be made with reference to FIG. 3.

The following Table 1 shows quantization angle information where the first quantization type includes eight quantization levels, and the following Table 2 shows quantization angle information where the second quantization type includes 16 quantization levels.

TABLE 1

| Index | Angle |
|---|---|
| 0 | 0 |
| 1 | 45 |
| 2 | 90 |
| 3 | 135 |
| 4 | 180 |
| 5 | 225 |
| 6 | 270 |
| 7 | 315 |

TABLE 2

| Index | Angle |
|---|---|
| 0 | 0 |
| 1 | 22.5 |
| 2 | 45 |
| 3 | 67.5 |
| 4 | 90 |
| 5 | 112.5 |
| 6 | 135 |
| 7 | 157.5 |
| 8 | 180 |
| 9 | 202.5 |
| 10 | 225 |
| 11 | 247.5 |
| 12 | 270 |
| 13 | 292.5 |
| 14 | 315 |
| 15 | 337.5 |

Exemplary embodiments of operations of the encoding apparatus 100 of the multi-channel signal to decrease a bit amount of a transmission bitstream and decrease a deterioration of a sound quality are described above. Hereinafter, a decoding apparatus of a multi-channel signal according to an exemplary embodiment will be described in detail with reference to FIG. 3.

Figure 3:
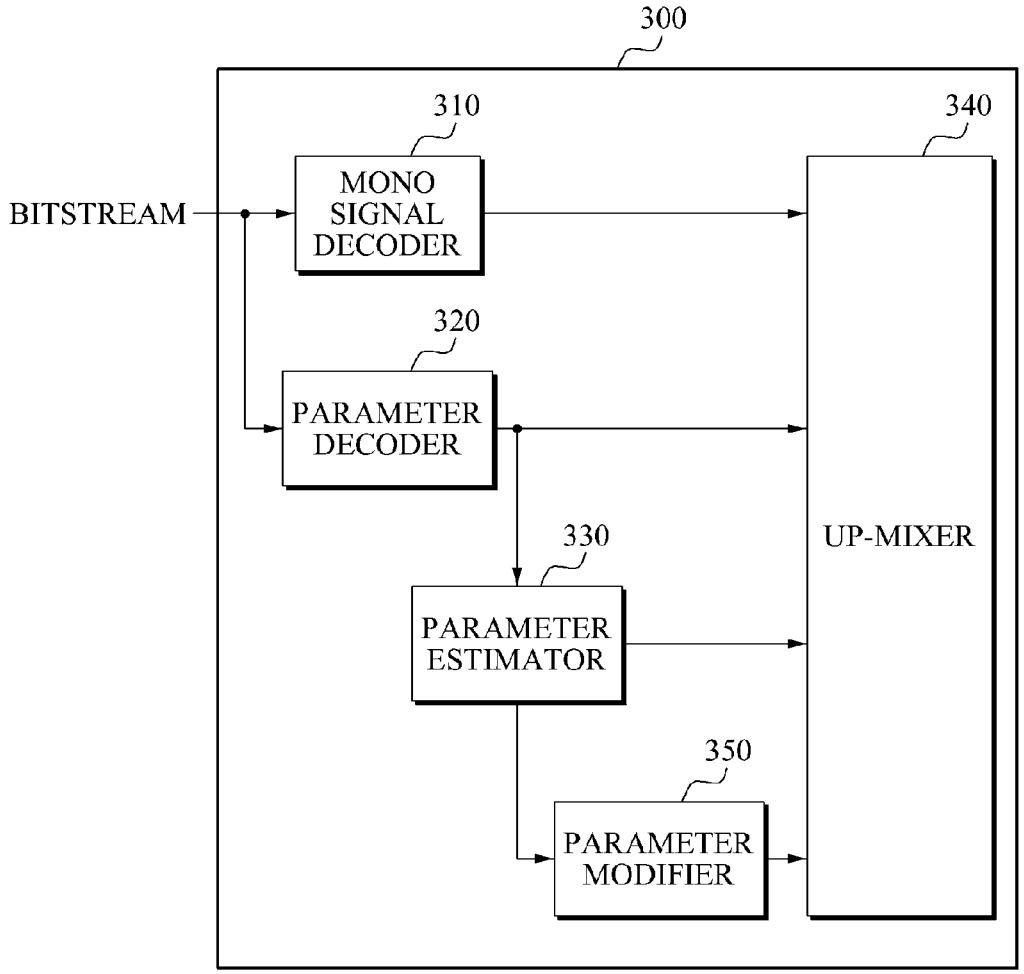
FIG. 3 illustrates a configuration of a decoding apparatus of a multi-channel signal according to an exemplary embodiment.

FIG. 3 illustrates a configuration of a decoding apparatus 300 of a multi-channel signal according to an exemplary embodiment.

Referring to FIG. 3, the decoding apparatus 300 may include a mono signal decoder 310, a parameter decoder 320, a parameter estimator 330, an up-mixer 340, and a parameter modifier 350. Hereinafter, a function of each of constituent elements will be described in detail.

Here, it is assumed that a bitstream input into the decoding apparatus 300 is an encoded bitstream of a stereo signal.

Also, it is assumed that the input bitstream is generated through a de-multiplexing operation using an encoded mono signal and encoded parameters.

The mono signal decoder 310 may restore, from the encoded bitstream of the stereo signal, a mono signal that is a down-mixed signal of the multi-channel signal. For example, when the mono signal is encoded in a time domain, the mono signal decoder 310 may decode the encoded mono signal in the time domain. When the mono signal is encoded in a frequency domain, the mono signal decoder 310 may decode the encoded mono signal in the frequency domain.

The parameter decoder 320 may restore, from the encoded bitstream of the stereo signal, a plurality of parameters that indicate a characteristic relationship between a plurality of channels constituting the multi-channel signal. The plurality of parameters may include a CLD, an ICC, and an IPD, but may not include an OPD.

The parameter estimator 330 may estimate the OPD using the restored parameters.

Hereinafter, an operation of the parameter estimator 330 will be described in detail. The following equations are only examples and thus modifications may be made thereto.

The parameter estimator 330 may obtain a first intermediate variable c using the CLD according to the following Equation 8:

$$c(b) = 10^{\frac{CLD(b)}{20}}, \quad \text{[Equation 8]}$$

where b denotes an index of the frequency band. As shown in the above Equation 8, the first intermediate variable c may be calculated by expressing a number, obtained by dividing an IID value in a particular frequency band by 20, using an index form of 10. By using the first intermediate variable c, a second intermediate variable $c_1$ and a third intermediate variable $c_2$ may be obtained according to the following Equation 9 and Equation 10:

$$c_1(b) = \frac{\sqrt{2}}{\sqrt{1 + c^2(b)}}, \quad \text{[Equation 9]}$$

and $$c_2(b) = \frac{\sqrt{2}\, c(b)}{\sqrt{1 + c^2(b)}}. \quad \text{[Equation 10]}$$

Specifically, the third intermediate variable $c_2$ may be obtained by multiplying the second intermediate variable $c_1$ by the first intermediate variable c.

The parameter estimator 330 may obtain a first right-channel signal and a first left-channel signal using the restored mono signal, the second intermediate variable $c_1$ and the third intermediate variable $c_2$. The first right-channel signal may be given by the following Equation 11:

$$\hat{R}_{n,k}=c_1M_{n,k}, \quad \text{[Equation 11]}$$

where n denotes a time slot index and k denotes a parameter band index. The first right-channel signal $\hat{R}_{n,k}$ may be expressed by a multiplication of the second intermediate variable $c_1$ and the restored mono signal M.

The first left-channel signal may be given by the following Equation 12:

$$\hat{L}_{n,k}=c_2M_{n,k}. \quad \text{[Equation 12]}$$

The first left-channel signal $\hat{L}_{n,k}$ may be expressed by a multiplication of the second intermediate variable $c_2$ and the restored mono signal M.

When the IPD is $\phi$, a first mono signal $\hat{M}_{n,k}$ may be expressed using the first right-channel signal $\hat{R}_{n,k}$ and the second left-channel signal $\hat{L}_{n,k}$, as given by the following Equation 13:

$$|\hat{M}_{n,k}|=\sqrt{|\hat{L}_{n,k}|^2+|\hat{R}_{n,k}|^2-2|\hat{L}_{n,k}||\hat{R}_{n,k}|\cos(\pi-\phi)}. \quad \text{[Equation 13]}$$

By using the above Equation 10 through Equation 13, a fourth intermediate variable p may be given by the following Equation 14:

$$p_{n,k}=\frac{|\hat{L}_{n,k}|+|\hat{R}_{n,k}|+|\hat{M}_{n,k}|}{2}. \quad \text{[Equation 14]}$$

The fourth intermediate variable p may be determined as a value that is obtained by dividing a magnitude sum of the first left-channel signal, the first right-channel signal, and the first mono signal by 2. When a value of the OPD is $\phi_1$, the OPD may be obtained according to the following Equation 15:

$$\varphi_1=2\arctan\left(\sqrt{\frac{(p_{n,k}-|\hat{L}_{n,k}|)(p_{n,k}-|\hat{M}_{n,k}|)}{p_{n,k}(p_{n,k}-|\hat{R}_{n,k}|)}}\right). \quad \text{[Equation 15]}$$

Also, when a value corresponding to a difference between the OPD and the IPD is $\phi_2$, $\phi_2$ may be obtained according to the following Equation 16:

$$\varphi_2=2\arctan\left(\sqrt{\frac{(p_{n,k}-|\hat{R}_{n,k}|)(p_{n,k}-|\hat{M}_{n,k}|)}{p_{n,k}(p_{n,k}-|\hat{L}_{n,k}|)}}\right). \quad \text{[Equation 16]}$$

$\phi_1$ obtained through the above Equation 15 denotes a phase difference between a decoded mono signal and a left-channel signal to be up-mixed. Also, $\phi_2$ obtained through the above Equation 16 denotes a phase difference between the decoded mono signal and a right-channel signal to be up-mixed.

The parameter estimator 330 may generate, from the restored mono signal, the first left-channel signal and the first right-channel signal with respect to the left-channel signal and the right-channel signal using the IID. The parameter estimator 330 may generate the first mono signal from the first left-channel signal and the first right-channel signal using the IPD. Also, the parameter estimator 330 may estimate the value of the OPD using the first left-channel signal, the first right-channel signal, and the first mono signal. Here, the IID indicates a magnitude difference between channels of the stereo signal. The IPD indicates a phase difference between the channels of the stereo signal. The OPD indicates a phase difference between the restored mono signal and the stereo signal.

The up-mixer 340 may up-mix the mono signal using restored at least one parameter and the estimated OPD.

Up-mixing may generate a stereo signal of at least two channels from a mono signal of a single channel, and may correspond to down-mixing. Hereinafter, an operation of the up-mixer 340 to up-mix the mono signal using the CLD, the ICC, the IPD, and the OPD will be described in detail.

When a value of the ICC is $\rho$, the up-mixer 340 may obtain a first phase $\alpha+\beta$ and a second phase $\alpha-\beta$ using the second intermediate variable $c_1$ and the third intermediate variable $c_2$. The first phase $\alpha+\beta$ and the second phase $\alpha-\beta$ may be given by the following Equation 17 and Equation 18:

$$\alpha+\beta=\frac{1}{2}\arccos\rho\cdot\left(1+\frac{c_1-c_2}{\sqrt{2}}\right), \quad \text{[Equation 17]}$$

and $$\alpha-\beta=\frac{1}{2}\arccos\rho\cdot\left(1-\frac{c_1-c_2}{\sqrt{2}}\right). \quad \text{[Equation 18]}$$

When the restored mono signal is M and a decorrelated signal is D, the up-mixer 340 may obtain an up-mixed left-channel signal and an up-mixed right-channel signal, using the first phase $\alpha+\beta$, the second phase $\alpha-\beta$, the second intermediate variable $c_1$, the third intermediate variable $c_2$, $\phi_1$, and $\phi_2$. The up-mixed left-channel signal and the up-mixed right-channel signal may be given by the following Equation 19 and Equation 20:

$$\hat{L}'=(M\cdot\cos(\alpha+\beta)+D\cdot\sin(\alpha+\beta))\cdot\exp(j\phi_1)\cdot c_2, \quad \text{[Equation 19]}$$

and $$\hat{R}'=(M\cdot\cos(\alpha-\beta)-D\cdot\sin(\alpha-\beta))\cdot\exp(j\phi_2)\cdot c_1. \quad \text{[Equation 20]}$$

As described above, the decoding apparatus 300 may estimate an OPD value using transmitted parameters, and may restore the stereo signal using the estimated OPD value and the transmitted parameters.

However, as described above with reference to FIG. 2, when the OPD estimated using the transmitted parameters radically changes in consecutive frames, noise may occur which may result in deteriorating a sound quality. Accordingly, when an encoding end transmits the phase parameter without modifying the phase parameter, the decoding apparatus 300 may need to modify the phase parameter to decrease the noise.

For the above operation, the decoding apparatus 300 may modify the estimated OPD and restore the stereo signal using the modified OPD and the restored parameters.

When the restored parameters include the CLD and the IPD, the decoding apparatus 300 may modify the OPD based on the CLD and the IPD. The modification of the parameters may be performed by the parameter modifier 350.

For example, when the restored IPD is 180 degrees, the parameter modifier 350 may modify the estimated OPD to zero degrees.

As another example, when the restored IPD is not 180 degrees, the parameter modifier 350 may modify the estimated OPD using the CLD. The modified OPD may correspond to either a value between the restored OPD and zero degrees or a value between the restored OPD and −180 degrees.

When the restored IPD varies around 180 degrees, the estimated OPD may radically change from around 90 degrees to −90 degrees. In order to prevent the radical change of the OPD, when the IPD is 180 degrees, the parameter modifier 350 may set the OPD to zero degrees. When the IPD has a value around 180 degrees, the parameter modifier 350 may set the OPD value to either a value between 90 degrees and zero degrees or a value between −90 degrees and zero degrees, for example, may set the OPD to either 67.5 degrees or −67.5 degrees. Accordingly, the OPD may not radically changed from 90 degrees to −90 degrees and gradually change in an order of 67.5 degrees, zero degrees, and −67.5 degrees, whereby it is possible to prevent radical change of phase information.

The aforementioned modification of the OPD may be performed according to the following Equation 21:

[Equation 21]

$$\text{if}$$

$$IPD = 180° \ \& \ CLD = 0, OPD = 0°$$

$$\text{else}$$

$$OPD = \arctan\left(\frac{c_2 \sin(IPD)}{c_1 + c_2 \cos(IPD)}\right)$$

$$\text{with}$$

$$c_1 = \sqrt{\frac{10^{\frac{CLD}{10}}}{1 + 10^{\frac{CLD}{10}}}},$$

$$\text{and}$$

$$c_2 = \sqrt{\frac{1}{1 + 10^{\frac{CLD}{10}}}}.$$

The parameter modifier 350 may filter and modify the estimated OPD and so that a change amount of the estimated OPD may decrease.

For example, the parameter modifier 350 may modify the estimated OPD using an infinite impulse response (IIR) filter.

The parameter modifier 350 may filter the estimated OPD based on the following Equation 22:

[Equation 22]

$$\phi'_{frame,band} = \alpha \cdot \phi_{frame,band} + (1-\alpha) \cdot \phi_{frame-1,band},$$

where $\phi_{frame,band}$ denotes phase information regarding a signal included in a particular frequency band in a current frame, $\phi_{frame-1,band}$ denotes phase information regarding a signal included in a particular frequency band in a previous frame being one frame prior to the current frame, $\alpha$ denotes a real number greater than zero and less than 1, and $\phi'_{frame,band}$ denotes filtered phase information of the signal included in the particular frequency band in the current frame.

The parameter modifier 360 may assign a first weight $\alpha$ to $\phi_{frame,band}$ and assign a second weight $(1-\alpha)$ to $\phi_{frame-1,band}$, and may add up the weighted $\phi_{frame,band}$ and the weighted $\phi_{frame-1,band}$ to thereby decrease a change amount of the estimated OPD.

In the above case, whether to filter the estimated OPD may be determined by the encoding end. The encoding end may include information associated with filtering in a bitstream and transmit the bitstream to the decoding apparatus 300. The parameter modifier 350 may determine whether to perform filtering based on the information.

As described above with reference to FIG. 1, the encoding end may select a quantization type based on a continuity of phase information, and may generate the bitstream containing a phase parameter, quantized according to the selected quantization type, and quantization type information.

When the decoding apparatus 300 receives the bitstream containing the quantized phase parameter and the quantization type information, the parameter decoder 320 may restore, from the bitstream, the quantized phase parameter (hereinafter, a first phase parameter) and the quantization type information, and perform inverse-quantization for the first phase parameter based on the restored quantization type information to calculate a second phase parameter.

In this case, the up-mixer 340 may up-mix the mono signal using the remaining parameters excluding the first phase parameter and the second phase parameter from the plurality of parameters.

Accordingly, the decoding apparatus 300 may decrease a deterioration of a sound quality that may occur due to quantization of the phase parameter and a discontinuous phase value.

Figure 4:
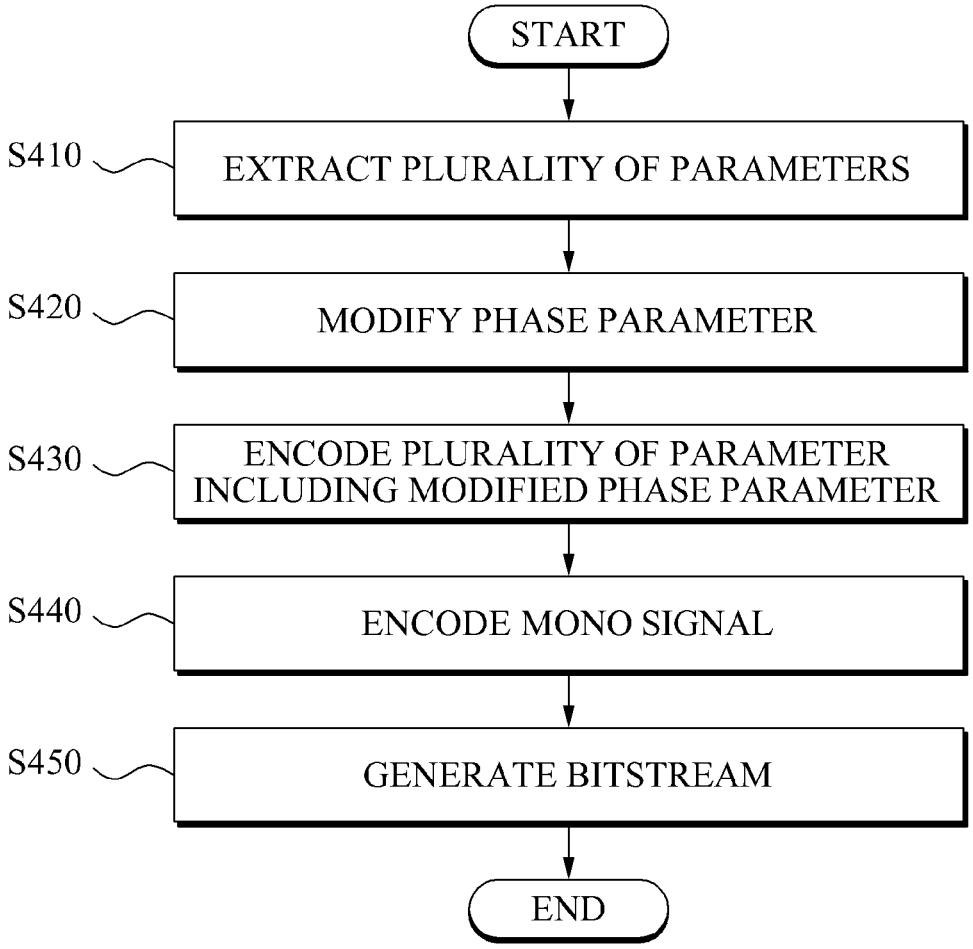
FIG. 4 illustrates a flowchart of an encoding method of a multi-channel signal according to an exemplary embodiment.

FIG. 4 illustrates a flowchart of an encoding method of a multi-channel signal according to an exemplary embodiment.

Referring to FIG. 4, the encoding method of the multi-channel signal may include operations performed by the encoding apparatus 100 of FIG. 1 and thus may be performed by the encoding apparatus 100. Accordingly, descriptions made above with reference to the encoding apparatus 100 may be applicable to the encoding method of FIG. 4.

In operation S410, the encoding apparatus 100 may extract a plurality of parameters that indicate a characteristic relationship between a plurality of channels constituting the multi-channel signal.

In operation S420, the encoding apparatus 100 may modify a phase parameter associated with phase information between the plurality of channels among the plurality of parameters.

The phase parameter may include an IPD.

The plurality of parameters may include a CLD. When the CLD is zero and the IPD is 180 degrees, the encoding apparatus 100 may modify the IPD to zero degrees in operation S420.

In operation S430, the encoding apparatus 100 may encode the plurality of parameters that includes the modified phase parameter.

In operation S440, the encoding apparatus 100 may encode a mono signal that is a down-mixed signal of the multi-channel signal.

In operation S450, the encoding apparatus 100 may generate an encoded bitstream with respect to the multi-channel signal using the encoded parameters and the encoded mono signal.

Figure 5:
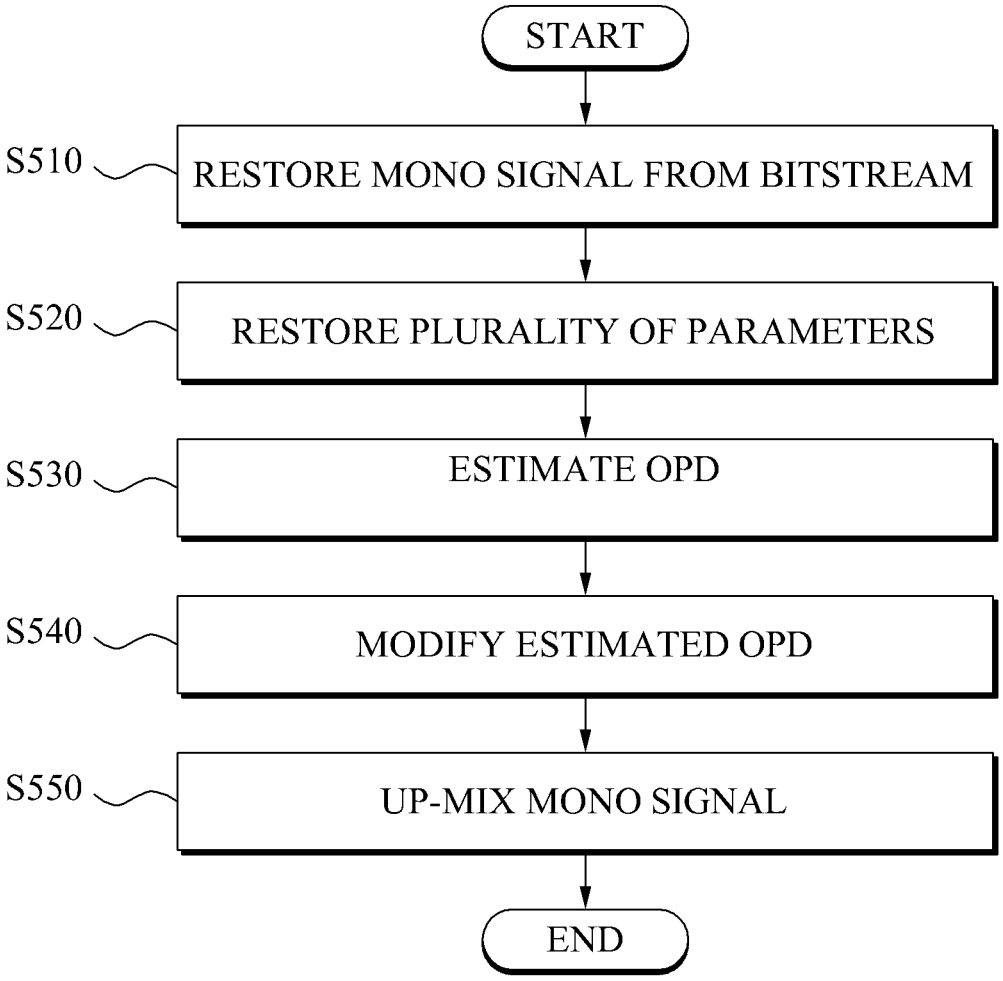
FIG. 5 illustrates a flowchart of a decoding method of a multi-channel signal according to an exemplary embodiment.

FIG. 5 illustrates a flowchart of a decoding method of a multi-channel signal according to an exemplary embodiment.

Referring to FIG. 5, the decoding method of the multi-channel signal may include operations performed by the decoding apparatus 300 of FIG. 3 and thus may be performed by the decoding apparatus 300. Accordingly, descriptions made above with reference to the decoding apparatus 300 may be applicable to the encoding method of FIG. 5.

In operation S510, the decoding apparatus 300 may restore, from an encoded bitstream of the multi-channel signal, a mono signal that is a down-mixed signal of the multi-channel signal.

In operation S520, the decoding apparatus 300 may restore, from the bitstream, a plurality of parameters that indicate a characteristic relationship between a plurality of channels constituting the multi-channel-signal.

In operation S530, the decoding apparatus 300 may estimate an OPD using the restored parameters.

In operation S540, the decoding apparatus 300 may modify the estimated OPD.

The plurality of parameters may include a CLD and an IPD. In operation S540, the decoding apparatus 300 may modify the OPD based on the CLD and the IPD.

In this case, when the IPD is 180 degrees, the decoding apparatus 300 may modify the OPD to zero degrees in operation S540. Conversely, when the IPD is not 180 degrees, the decoding apparatus 300 may modify the OPD using the CLD. The modified OPD may correspond to either a value between the restored OPD and zero degrees or a value between the restored OPD and −180 degrees.

Also, the decoding apparatus 300 may filter and modify the estimated OPD so that a change amount of the estimated OPD may decrease. In this case, the decoding apparatus 300 may filter the estimated OPD using an IIR filter.

In operation S550, the decoding apparatus 300 may up-mix the mono signal using at least one restored parameter and the modified OPD.

The above-described exemplary embodiments may be recorded in computer-readable media including program instructions to implement various operations embodied by a computer. The media may also include, alone or in combination with the program instructions, data files, data structures, and the like. Examples of computer-readable media (computer-readable storage devices) include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may be a plurality of computer-readable storage devices in a distributed network, so that the program instructions are stored (recorded) in the plurality of computer-readable storage devices and executed in a distributed fashion. The program instructions may be executed by one or more processors or processing devices. The computer-readable media may also be embodied in at least one application specific integrated circuit (ASIC) or Field Programmable Gate Array (FPGA). Examples of program instructions include both machine code, such as produced by a compiler, and files containing higher level code that may be executed by the computer using an interpreter. The described hardware devices may be configured to act as one or more software modules in order to perform the operations of the above-described exemplary embodiments, or vice versa.

Although a few exemplary embodiments have been shown and described, it would be appreciated by those skilled in the art that changes may be made in these exemplary embodiments without departing from the principles and spirit of the disclosure, the scope of which is defined by the claims and their equivalents.

What is claimed is:

1. A method, performed by at least one processor, of generating a multi-channel signal from a down-mixed mono signal, the method comprising:

decoding the down-mixed mono signal from a received bitstream;

decoding, from the received bitstream, a plurality of parameters that indicate characteristic relations between channels, wherein the decoded parameters include an inter-channel phase difference (IPD) between a left audio signal and a right audio signal, and a channel level difference (CLD) between the left audio signal and the right audio signal;

estimating, by using the decoded parameters, an overall phase difference (OPD) parameter representing a phase difference between the down-mixed mono signal and one of the left signal and the right signal; and up-mixing the decoded down-mixed mono signal to generate the multi-channel signal, using the decoded parameters and the estimated OPD parameter, wherein the estimating of the OPD parameter includes estimating the OPD parameter to be zero when the IPD is 180° and the CLD is 0.

2. The method of claim 1, wherein: when the IPD is not 180°, the OPD parameter is estimated using the CLD and the IPD, and the estimated OPD parameter corresponds to either a value between the estimated OPD parameter and zero or a value between the estimated OPD parameter and −180°.

3. The method of claim 1, wherein the estimated OPD parameter is filtered to decrease a change amount of the estimated OPD parameter.

4. The method of claim 3, wherein the estimated OPD parameter is filtered using an infinite impulse response filter.

* * * * *